US011512886B2

(12) United States Patent
Jeong et al.

(10) Patent No.: US 11,512,886 B2
(45) Date of Patent: Nov. 29, 2022

(54) REFRIGERATOR

(71) Applicant: SAMSUNG ELECTRONICS CO., LTD., Suwon-si (KR)

(72) Inventors: Jin Jeong, Suwon-si (KR); Young Il Song, Suwon-si (KR); Do Yun Jang, Suwon-si (KR); Kook Jeong Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 49 days.

(21) Appl. No.: 17/260,634

(22) PCT Filed: Jun. 26, 2019

(86) PCT No.: PCT/KR2019/007708
§ 371 (c)(1),
(2) Date: Jan. 15, 2021

(87) PCT Pub. No.: WO2020/017775
PCT Pub. Date: Jan. 23, 2020

(65) Prior Publication Data

US 2021/0270513 A1 Sep. 2, 2021

(30) Foreign Application Priority Data

Jul. 17, 2018 (KR) ..... 10-2018-0082885

(51) Int. Cl.
*F25C 5/08* (2006.01)
*F25C 1/04* (2018.01)
*F25C 5/182* (2018.01)

(52) U.S. Cl.
CPC ..... *F25C 5/08* (2013.01); *F25C 1/04* (2013.01); *F25C 5/182* (2013.01)

(58) Field of Classification Search
CPC .... F25C 5/08; F25C 1/04; F25C 5/182; F25C 2400/14; F25C 1/25
See application file for complete search history.

(56) References Cited

U.S. PATENT DOCUMENTS

2006/0016205 A1* 1/2006 Tremblay ..... F25C 1/04 62/340
2015/0241102 A1* 8/2015 Lee ..... F25C 1/25 62/344

(Continued)

FOREIGN PATENT DOCUMENTS

KR 20-0220188 6/2001
KR 10-2008-0106688 12/2008

(Continued)

OTHER PUBLICATIONS

International Search Report dated Oct. 25, 2019 in International Patent Application No. PCT/KR2019/007708.

(Continued)

*Primary Examiner* — Elizabeth J Martin
(74) *Attorney, Agent, or Firm* — Staas & Halsey LLP

(57) ABSTRACT

A refrigerator including a main body, a door, and an ice making chamber provided in the door and including an ice maker to make ice and an ice bucket to store the ice produced. The ice maker includes an ice making tray having a plurality of ice making cells for receiving water, an ice separation heater to heat the ice making tray so that ice is separated from the ice making tray, an ejector rotatably provided to transfer the ice separated to the outside of the ice making tray, and a water channel formed on partitions partitioning the plurality of ice making cells to allow water to flow between the partitions and configured such that at least one of surfaces in contact with ice has a tapered shape in which a thickness thereof gradually decreases in a direction of directing to the ice.

12 Claims, 16 Drawing Sheets

(56) References Cited

U.S. PATENT DOCUMENTS

| | | | | |
|---|---|---|---|---|
| 2016/0245574 | A1* | 8/2016 | Jeong | F25C 1/18 |
| 2016/0370067 | A1* | 12/2016 | Park | F25C 1/243 |
| 2016/0370068 | A1* | 12/2016 | Yang | F25C 1/24 |
| 2018/0017307 | A1 | 1/2018 | Jeong et al. | |

FOREIGN PATENT DOCUMENTS

| | | |
|---|---|---|
| KR | 20-2008-0006235 | 12/2008 |
| KR | 10-2010-0002848 | 1/2010 |
| KR | 10-2012-0082990 | 7/2012 |
| KR | 10-2013-0078530 | 7/2013 |
| KR | 10-2016-0149097 | 12/2016 |
| KR | 10-2018-0020767 | 2/2018 |

OTHER PUBLICATIONS

Korean Office Action dated Aug. 12, 2022 in Korean Patent Application No. 10-2018-0082885 (7 pages; 8 pages English translation).

* cited by examiner

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2019/007708, filed Jun. 26, 2019 which claims the foreign priority benefit under 35 U.S.C. § 119 of Korean Patent Application No. 10-2018-0082885, filed Jul. 17, 2018, the contents of which are incorporated herein by reference.

TECHNICAL FIELD

The present disclosure relates to a refrigerator capable of reducing noise generated when ice moving from an ice making tray falls.

BACKGROUND ART

A refrigerator is a home appliance including a main body having a storage compartment, a cold air supply device for supplying cold air to the storage compartment, and a door for opening and closing the storage compartment to keep food fresh.

The refrigerator may further include an ice maker and an ice bucket to make and store ice, which is disposed in the main body or in an ice making chamber formed at the door.

In general, in the case of a bottom-mounted freezer (BMF) type refrigerator, the ice making chamber is provided in one corner of a refrigerating compartment or at a rear or front side of a refrigerating compartment door.

The ice maker may include an ice making tray having a plurality of ice making cells for receiving water, and an ejector for transferring ice from the ice making tray to the outside of the ice making tray.

When the respective pieces of ice that are transferred from the ice making tray to the outside of the ice making tray by the ejector are not separated and fall into the ice bucket while being attached to each other, a loud noise may be generated.

DISCLOSURE

Technical Problem

The present disclosure is directed to providing a refrigerator including an improved ice maker to reduce noise generated when ice to be transferred from an ice making tray to the outside of the ice making tray falls.

Technical Solution

One aspect of the present disclosure provides a refrigerator includes a main body having a storage compartment, a door rotatably coupled to the main body to open and close the storage compartment, and an ice making chamber provided in the door and including an ice maker configured to make ice and an ice bucket configured to store the ice produced by the ice maker, wherein the ice maker includes an ice making tray having a plurality of ice making cells for receiving water, an ice separation heater configured to heat the ice making tray so that ice is separated from the ice making tray, an ejector rotatably provided to transfer ice separated from the ice making tray to the outside of the ice making tray, and a water channel formed on each of partitions partitioning the plurality of ice making cells to allow water to flow between the partitions and configured such that at least one of surfaces in contact with ice has a tapered shape in which a thickness thereof gradually decreases in a direction of directing to the ice.

The water channel may include a first surface in contact with ice, a second surface formed at a position facing the first surface and in contact with ice, and a third surface formed between the first surface and the second surface and in contact with ice.

The first surface and the second surface may be configured to have a tapered shape in which a thickness thereof gradually decreases in a direction of directing to ice.

The ice making tray may include a pocket part receiving water to be supplied to the ice making cells, and the water channel closest to the pocket part among the plurality of water channels may be configured to have a larger width than the remaining water channels.

The remaining water channels may be configured to have the same width, and the water channels formed at positions facing each other may be formed at positions misaligned with each other.

The remaining water channels may be configured to have the same width, and some of the remaining water channels may be formed at positions facing each other, and some of the remaining water channels may be formed at positions misaligned with each other.

The ejector may include an ejector rotation shaft provided to be rotatable, and a plurality of ejector pins protruding from the ejector rotation shaft.

The plurality of ejector pins may be disposed to be spaced apart from each other to have a certain angle along a circumferential direction of the ejector rotation shaft.

The ice separation heater may have a U shape and may be disposed at a lower portion of the ice making tray so that heat of a higher temperature is transferred toward the pocket part.

The plurality of ejector pins may be configured such that the ejector pin closest to the pocket part first comes into contact with ice.

The plurality of ejector pins may include a plurality of ejector pin portions disposed to be spaced apart from each other to have the same angle along a circumferential direction of the ejector rotation shaft, and the plurality of ejector pin portions may be configured to have different angles along the circumferential direction of the ejector rotation shaft.

The ice separation heater may have a U shape and may be disposed at a lower portion of the ice making tray so that heat of a higher temperature is transferred toward the pocket part.

The plurality of ejector pin portions may be configured such that the ejector pin portion closest to the pocket part first comes into contact with ice.

The ice maker may further include an ejector pin guide configured to guide the plurality of ejector pins.

The ejector pin guide may include a rib-shaped guide lane configured to guide such that pieces of ice are maintained in a state of being separated from each other in a process in which the pieces of ice to be transferred to the outside of the ice making tray are separated.

Advantageous Effects

Refrigerators according to embodiments of the present disclosure can reduce noise generated when ice falls from an ice making tray.

MODE OF THE DISCLOSURE

Figure 1:
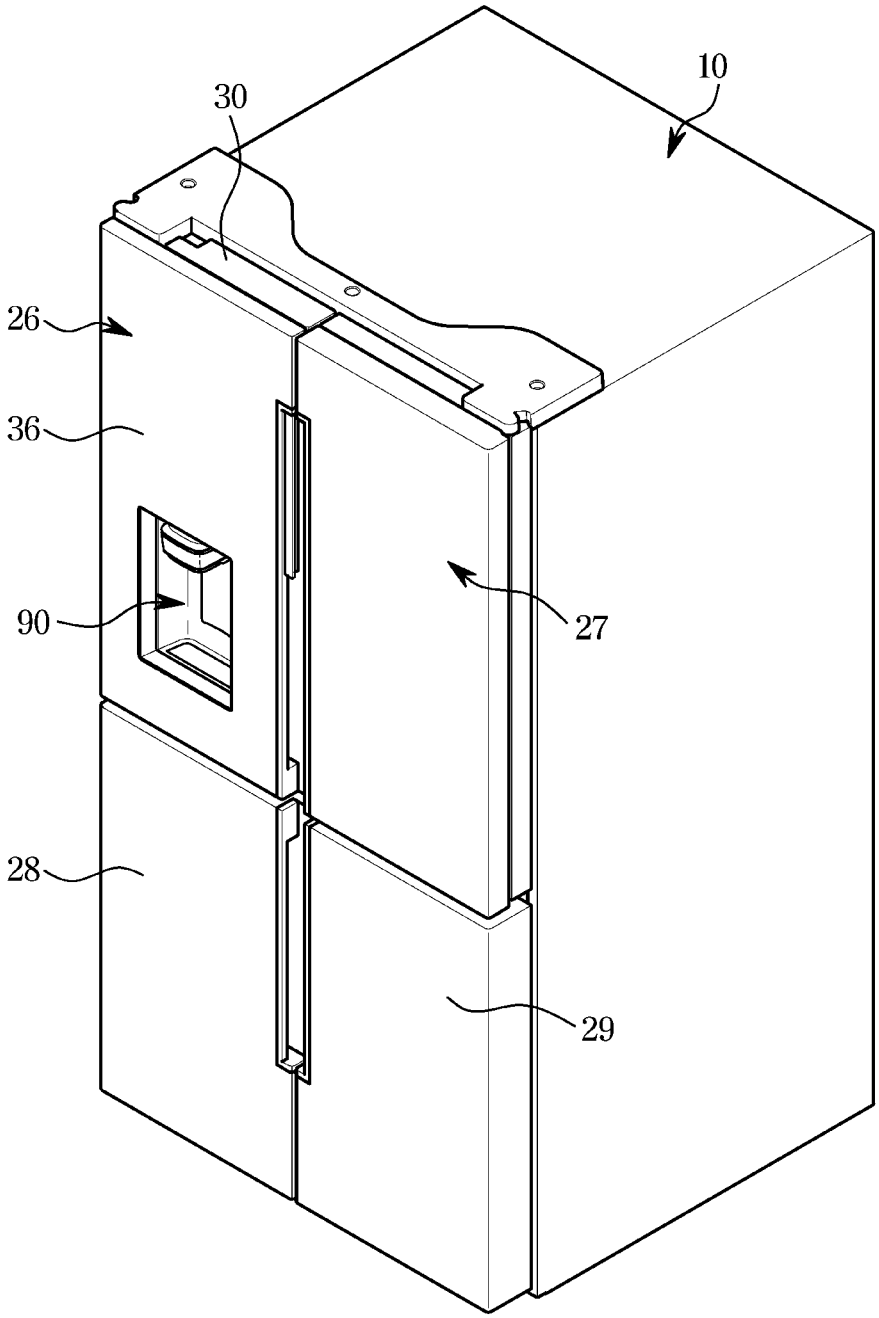
FIG. 1 is a perspective view of a refrigerator according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "front side," "rear side," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 2:
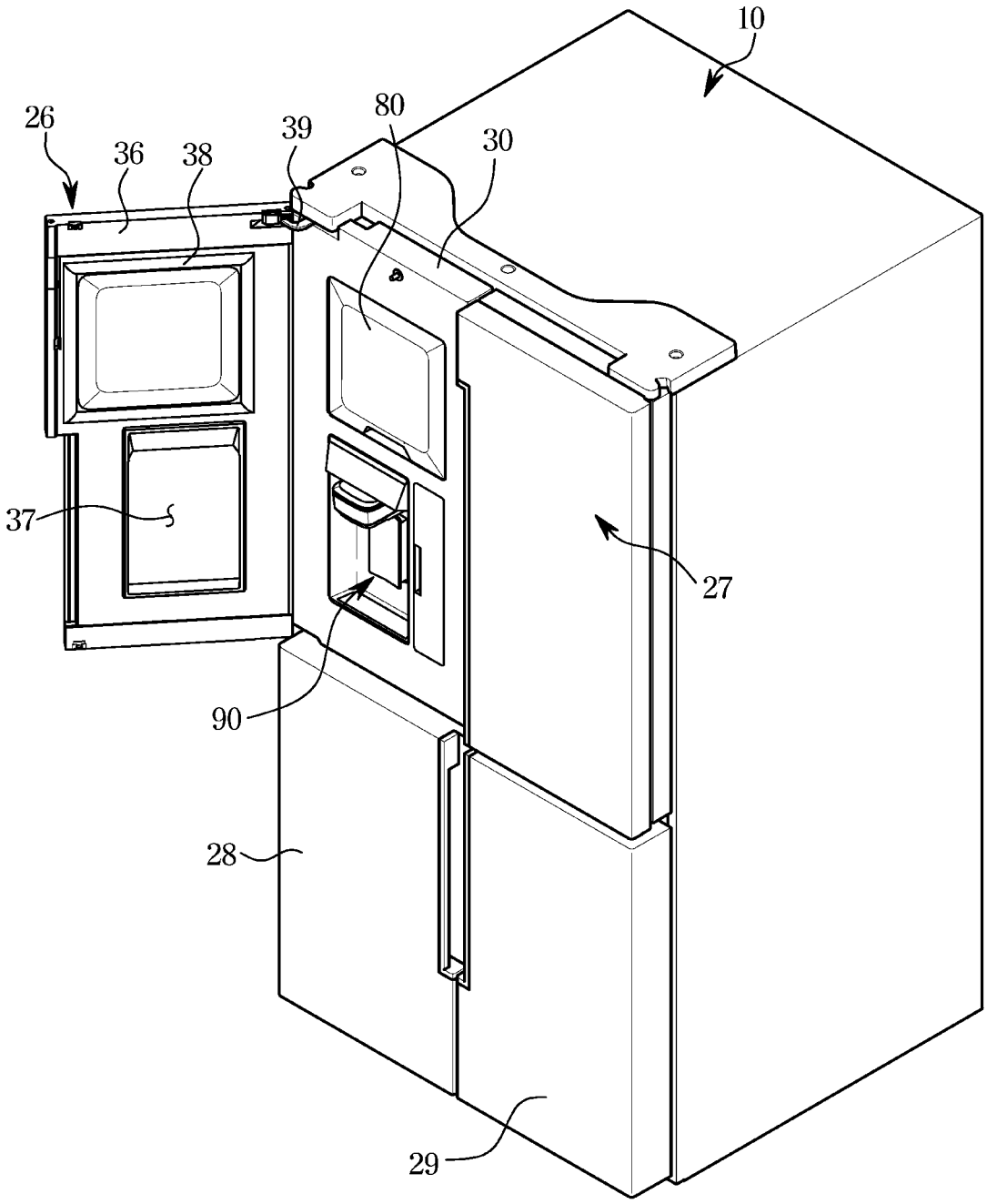
FIG. 2 illustrates that an ice making chamber door is opened in the refrigerator in FIG. 1.
Figure 3:
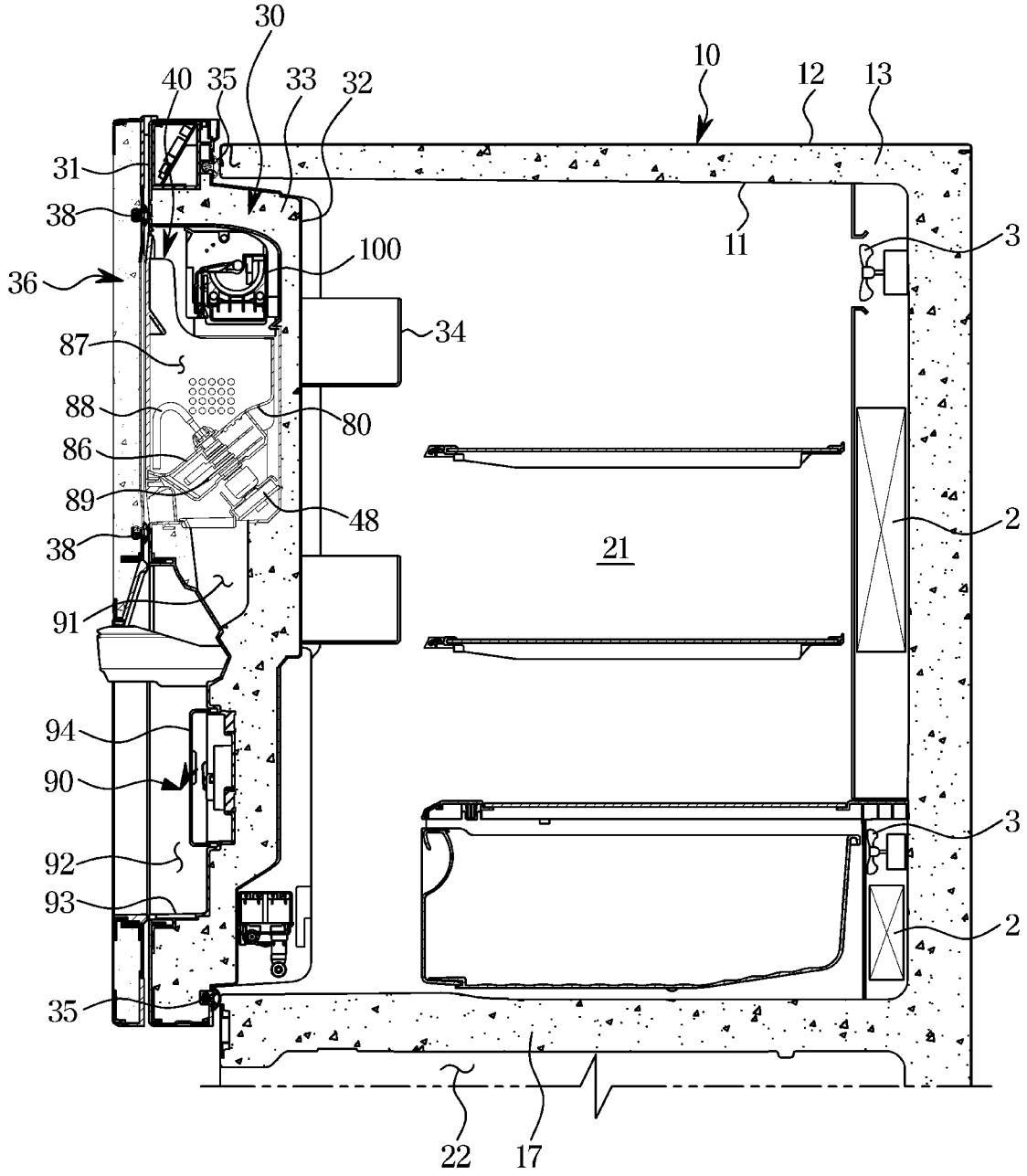
FIG. 3 is a side cross-sectional view illustrating main components of the refrigerator in FIG. 1.
Figure 4:
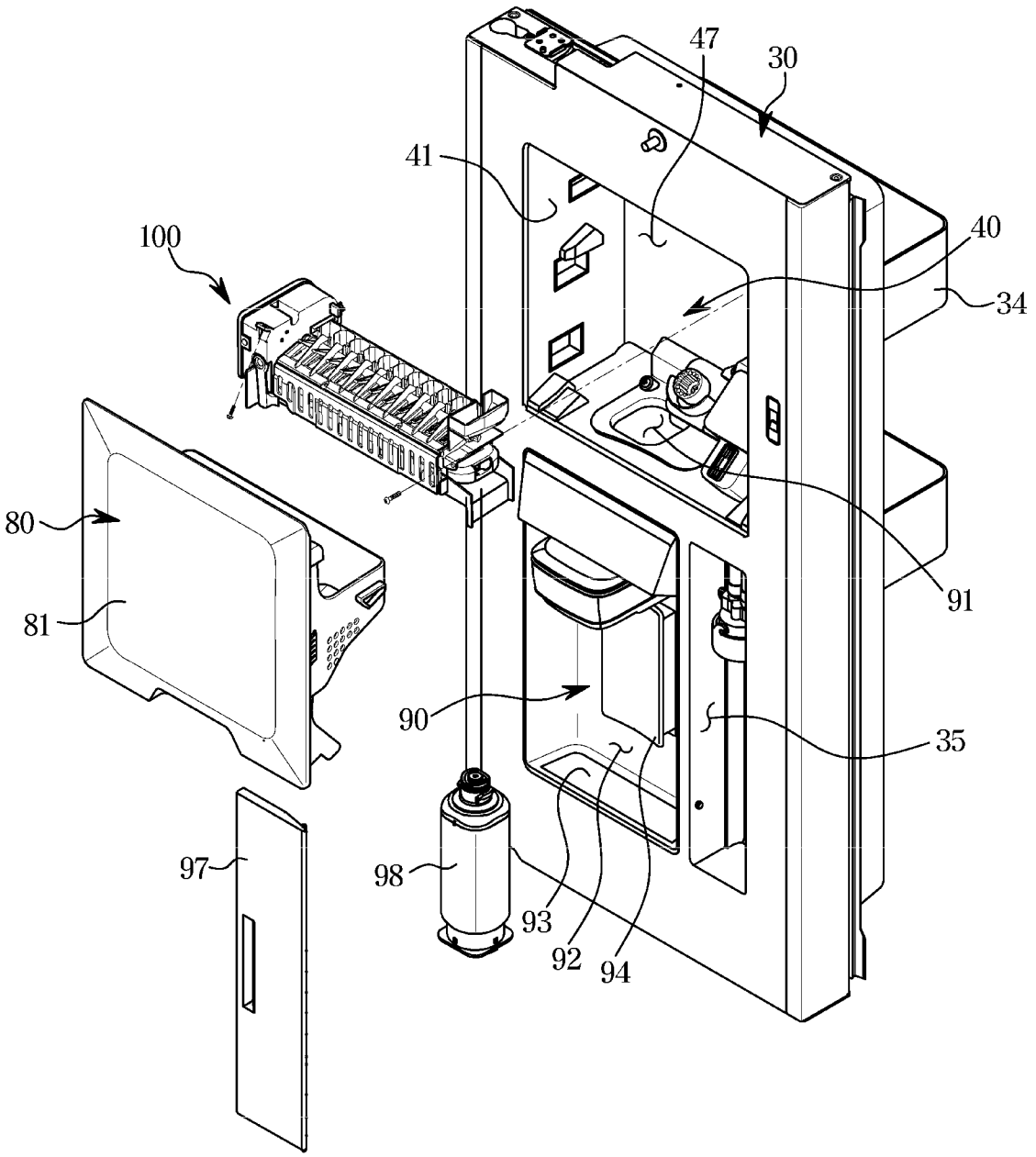
FIG. 4 is an exploded perspective view illustrating a storage compartment door and an ice making chamber of the refrigerator in FIG. 1.

FIG. 1 is a perspective view of a refrigerator according to an embodiment of the present disclosure, FIG. 2 illustrates that an ice making chamber door is opened in the refrigerator in FIG. 1, FIG. 3 is a side cross-sectional view illustrating main components of the refrigerator in FIG. 1, and FIG. 4 is an exploded perspective view illustrating a storage compartment door and an ice making chamber of the refrigerator in FIG. 1.

As illustrated in FIGS. 1 to 4, a refrigerator may include a main body 10 including storage compartments 21 and 22, doors 26, 27, 28, and 29 provided in front of the storage compartments 21 and 22, an ice making chamber 40 provided in the door 26, an ice maker 60 and an ice bucket 80 disposed in the ice making chamber 40, and a cold air supply device provided to supply cold air to the storage compartments 21 and 22 and ice making chamber 40.

The cold air supply device includes an evaporator 2, a compressor (not shown), a condenser (not shown), and an expansion device (not shown), and may generate cold air by using the latent heat of evaporation of a refrigerant.

The cold air generated by the evaporator 2 may be supplied to the storage compartment 21 and the ice making chamber 40 by the operation of a blowing fan 3.

The refrigerator 1 may include a cold air duct (not shown) for guiding the cold air generated by the evaporator 2 to the ice making chamber 40.

The main body 10 may include an inner case 11 forming the storage compartments 21 and 22, an outer case 12 coupled to an outer side of the inner case 12 and forming an outer appearance of the refrigerator 1, and an insulator 13 provided between the inner case 11 and the outer case 12 to insulate the storage compartments 21 and 22.

The inner case 11 may be formed by injection of a plastic material, and the outer case 12 may be formed of a metal material.

Urethane foam insulation may be used as the insulator 13, and a vacuum insulation panel may be used together as necessary.

The main body 10 may include an intermediate wall 17, and the storage compartments 21 and 22 may be divided into the upper storage compartment 21 and the lower storage compartment 22 by the intermediate wall 17.

The intermediate wall 17 may include an insulator to insulate the upper storage compartment 21 and the lower storage compartment 22.

The upper storage compartment 21 may be used as a refrigerating compartment for storing food in a refrigerating mode by maintaining indoor air at a temperature of about 0 to 5 degrees Celsius, and the lower storage compartment 22 may be used as a freezing compartment for storing food in a freezing mode by maintaining indoor air at a temperature of about 0 to −30 degrees Celsius.

The storage compartments 21 and 22 are provided with an open front side so that food may be put in and out, and the open front side of the storage compartments 21 and 22 may be opened and closed by the doors 26, 27, 28, and 29 which are rotatably provided in front of the storage compartments 21 and 22.

The storage compartment 21 may be opened and closed by the doors 26 and 27, and the storage compartment 22 may be opened and closed by the doors 28 and 29.

The door 26 may include a storage compartment door 30 rotatably coupled to the main body 10 to open and close the storage compartment 21, and an ice making chamber door 36 rotatably provided in front of the storage compartment door 30.

The storage compartment door 30 may be rotatably coupled to the main body 10 through a hinge member (not shown).

The ice making chamber door 36 may be rotatably coupled to the storage compartment door 30 or the main body 10 through a hinge member 39.

The storage compartment door 30 and the ice making chamber door 36 may be configured to be rotatable in the same direction.

The ice making chamber door 36 may have a size corresponding to a size of the storage compartment door 30.

Therefore, when both the storage compartment door 30 and the ice making chamber door 36 are closed, only a dispenser 90 is exposed to the outside through an opening 37 of the ice making chamber door 36, and the other portion of the storage compartment door 30 may be hidden by the ice making chamber door 36 not to be exposed.

The ice making chamber 40 may be formed on a front side of the storage compartment door 30.

The ice making chamber 40 may be partitioned, separated, and independent from the storage compartment 21 by the storage compartment door 30.

The storage compartment door 30 includes a front plate 31, a rear plate 32 coupled to a rear side of the front plate 31, and an insulator 33 provided between the front plate 31 and the rear plate 32, and the ice making chamber 40 may be formed by a partial region of the front plate 31 being recessed toward the insulator 33.

The ice making chamber 40 is provided with an open front side, and the open front side of the ice making chamber 40 may be opened and closed by the ice making chamber door 36.

Like the insulator 13 of the main body 10, urethane foam insulation may be used as the insulator 33, and a vacuum insulation panel may be used together as necessary.

The ice making chamber 40 may be insulated from the storage compartment 21 of the main body 10 by the insulator 33.

In the ice making chamber 40, the ice maker 60 capable of making ice and the ice bucket 80 capable of storing ice made by the ice maker 60 may be disposed.

A detailed structure of the ice maker 60 will be described later.

The ice making chamber 40 may include ice making chamber walls 41 and an ice making space 47 formed by the ice making chamber walls 41 and having an open front side.

The ice making chamber 40 also includes a guide rib (not shown) formed to support an ice making tray 61.

The ice bucket 80 may be detachably disposed in the ice making chamber 40 and may include an ice storage space 87 formed therein.

The ice bucket 80 may be provided with a transfer member 88 rotatable to stir and transfer ice, and a crushing blade 89 for crushing ice.

A transfer motor 48 for driving the transfer member 88 is provided in the ice making chamber 40, the transfer member 88 and the transfer motor 48 may be connected when the ice bucket 80 is mounted in the ice making chamber 40, and the transfer member 88 and the transfer motor 48 may be disconnected when the ice bucket 80 is separated from the ice making chamber 40.

A discharge port 86 is formed at a lower portion of the ice bucket 80 to discharge the stored ice, and the ice discharged from the ice bucket 80 may be transferred to a dispensing space 92 through a chute 91.

With this configuration, a user may access the ice making chamber 40 by opening only the ice making chamber door 36 without having to open the storage compartment door 30.

Therefore, operations such as taking out ice in the ice bucket 80 and separating the ice bucket 80 from the ice making chamber 40 for repair, cleaning, and replacement may be easily performed.

Also, because the user may access the ice making chamber 40 while the storage compartment door 30 is closed, leakage of cold air from the storage compartment 21 may be prevented and energy may be saved.

The storage compartment door 30 may include the dispenser 90 configured to provide water and ice to the user.

The dispenser 90 may include the dispensing space 92 recessed to receive water and ice, a dispensing tray 93 to allow a container such as a cup to be placed, and a dispensing switch 94 to input an operation command of the dispenser 90.

The storage compartment door 30 may include the chute 91 connecting the ice making chamber 40 and the dispensing space 92 to guide ice in the ice bucket 80 to the dispensing space 92.

The ice making chamber door 36 may have the opening 37 to allow the user to access the dispenser 90 of the storage compartment door 30 while the ice making chamber door 36 is closed.

The opening 37 may be formed at a position corresponding to the dispenser 90.

A door guard 34 for storing food may be provided on a rear side of the storage compartment door 30.

A gasket 35, which is in close contact with a front side of the main body 10 to seal the storage compartment 21, may be provided on the rear side of the storage compartment door 30, and a gasket 38, which is in close contact with the front side of the storage compartment door 30 to seal the ice making chamber 40, may be provided on a rear side of the ice making chamber door 36.

The refrigerator may include a water filter 98 provided to purify water and a water tank (not shown) provided to refrigerate and store water purified by the water filter 98.

A water filter accommodating portion 96 may be formed in the storage compartment door 30 to accommodate the water filter 98.

The water filter accommodating portion 96 may be formed on the front side of the storage compartment door 30 to be accessible in a state in which the storage compartment door 30 is closed and only the ice making chamber door 36 is open.

The water filter accommodating portion 96 is configured such that a front side is open, and a water filter cover 97 may be detachably provided on the open front side of the water filter accommodating portion 96.

The drawings illustrate that the ice making chamber 40 is formed in the storage compartment door 30, but the present disclosure is not limited thereto, and the ice making chamber 40 may be formed in the storage compartment 21.

Hereinafter, a configuration of an ice maker 100 according to an embodiment of the present disclosure will be described in detail.

Figure 5:
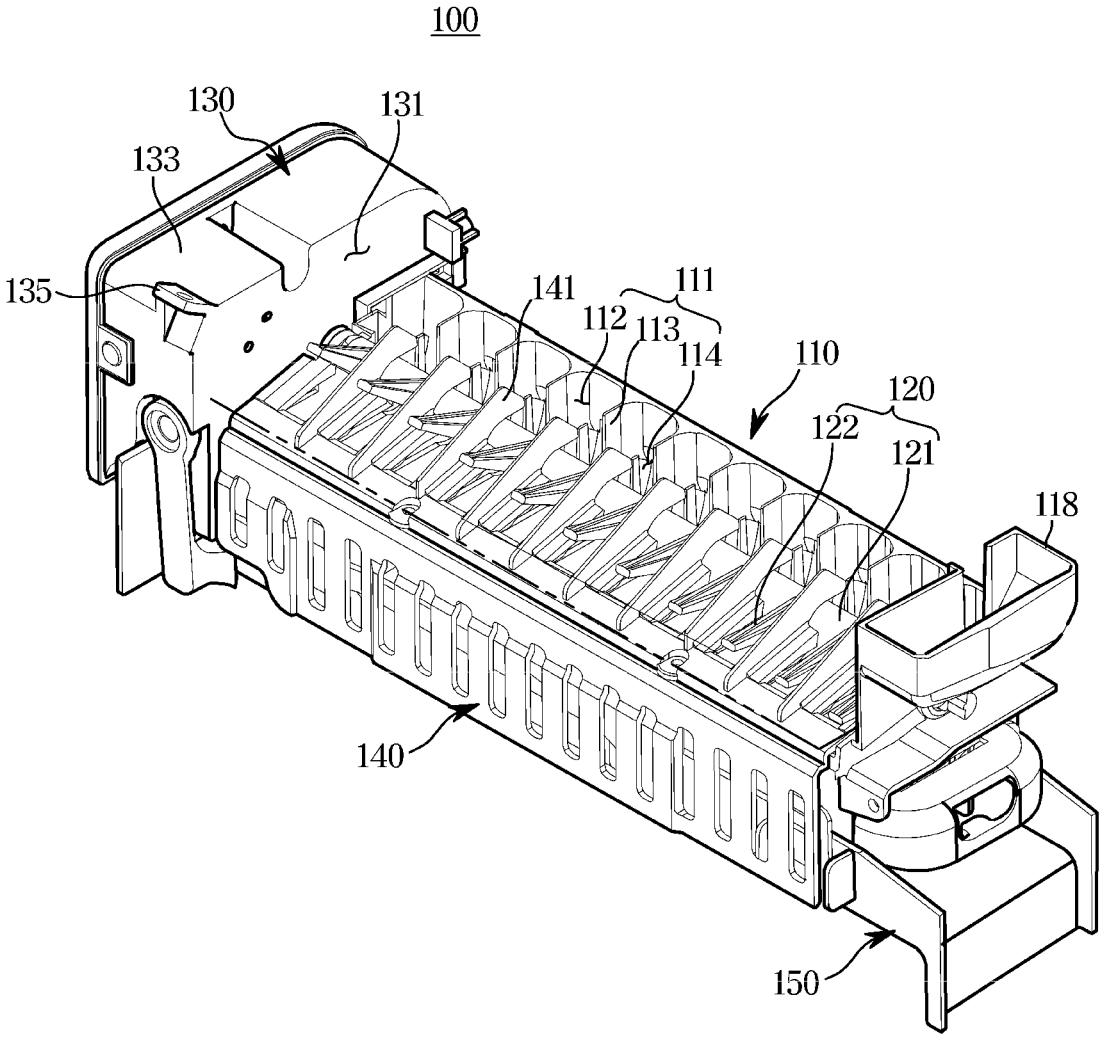
FIG. 5 is a perspective view of an ice maker according to an embodiment of the present disclosure.
Figure 6:
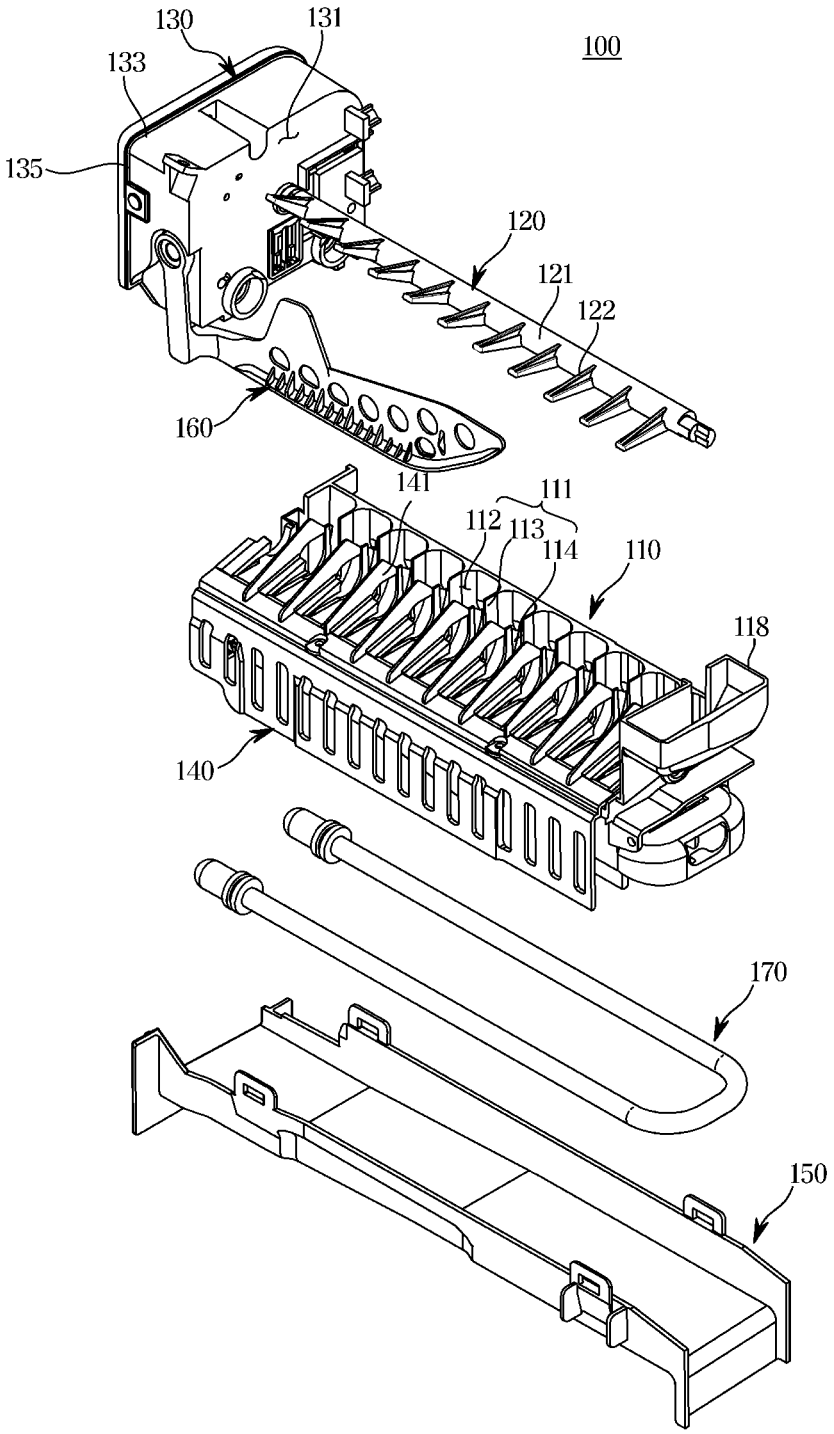
FIG. 6 is an exploded perspective view of a part of the ice maker according to an embodiment of the present disclosure.
Figure 7:
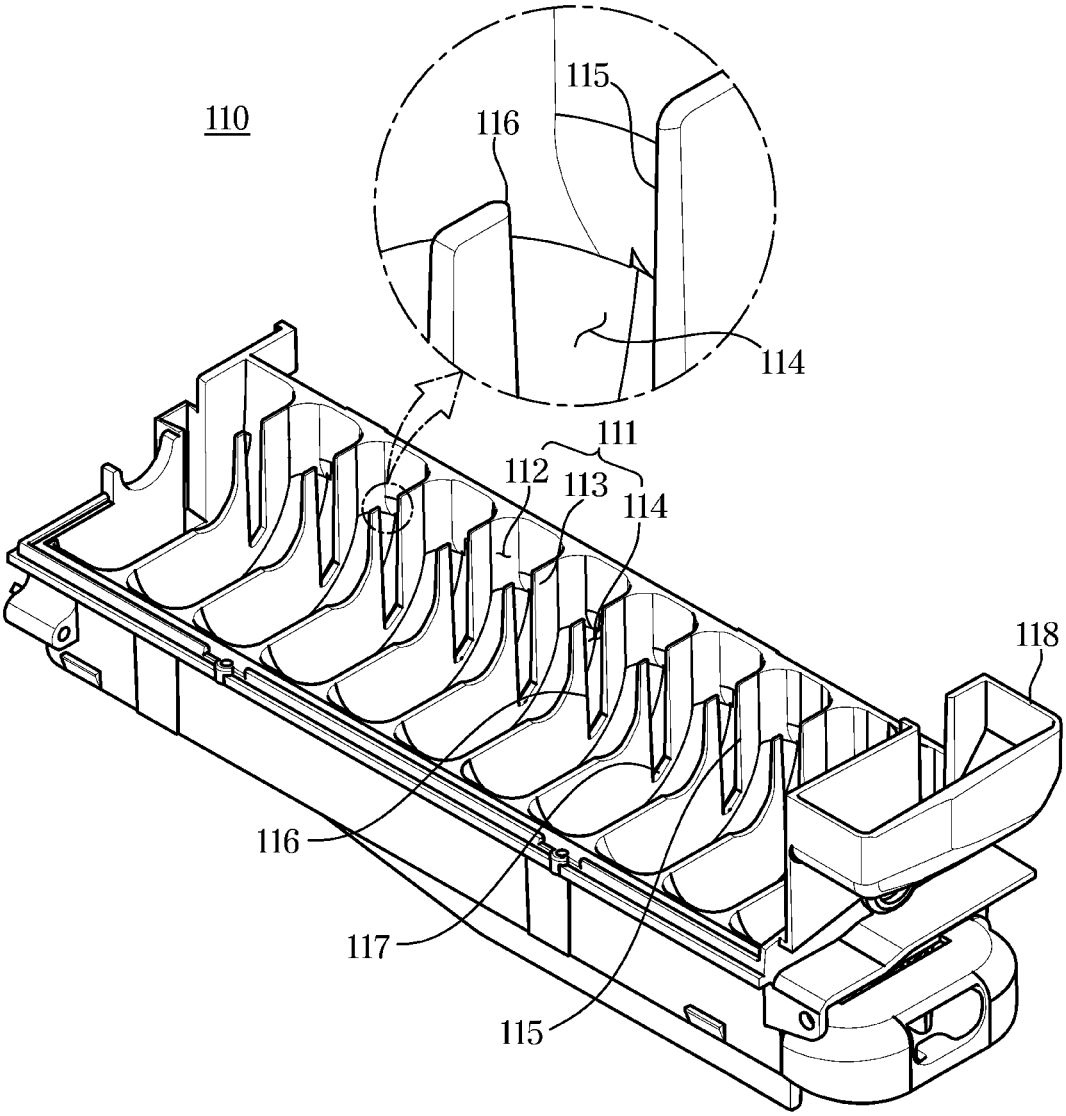
FIG. 7 illustrates an ice making tray in which a water channel is formed according to an embodiment of the present disclosure.
Figure 8:
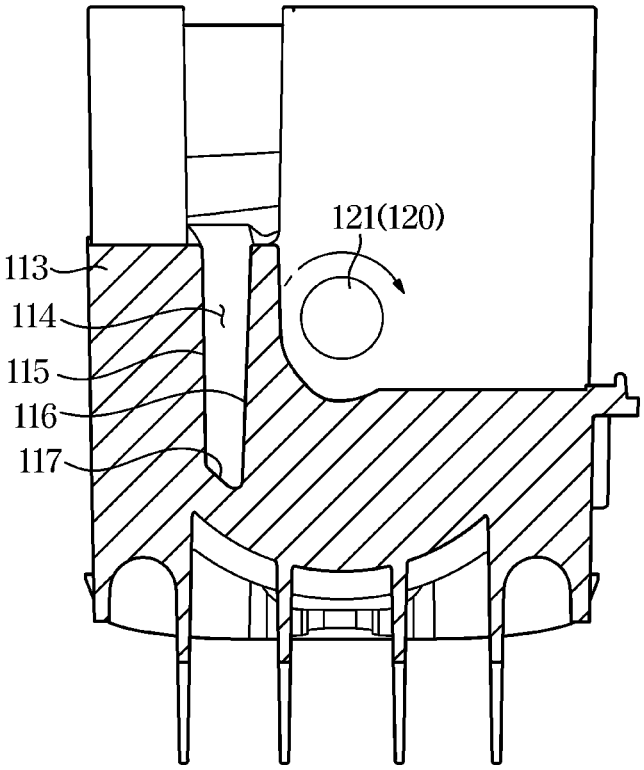
FIG. 8 is a side cross-sectional view of the ice making tray in which the water channel is formed according to an embodiment of the present disclosure.

FIG. 5 is a perspective view of an ice maker according to an embodiment of the present disclosure, FIG. 6 is an exploded perspective view of a part of the ice maker according to an embodiment of the present disclosure, FIG. 7 illustrates an ice making tray in which a water channel is formed according to an embodiment of the present disclosure, and FIG. 8 is a side cross-sectional view of the ice making tray in which the water channel is formed according to an embodiment of the present disclosure.

As illustrated in FIGS. 5 to 8, the ice maker 100 may include an ice making tray 110 having a plurality of ice making cells 112 provided to receive water, an ejector 120 rotatably provided to separate and move pieces of ice from the ice making cells 112, an ice separation motor (not shown) provided to rotate the ejector 120, a motor box 130 provided to accommodate the ice separation motor, an ejector pin guide 140 attached to a side portion of the ice making tray 110, a lower cover 150 attached to a lower portion of the ice making tray 110, a detection lever 160 provided to detect whether the ice bucket 80 is full with pieces of ice, and an ice separation heater 170 provided to heat the ice making tray 110 so that pieces of ice may be separated from the ice making chamber 112.

With this configuration, the ice maker may automatically perform a series of operations such as water supply, cooling, ice separating, and ice level detection.

The motor box 130 may protect the ice separation motor by accommodating the ice separation motor.

The motor box 130 may be coupled to one of opposite ends of the ice making tray 110 in a longitudinal direction at which a pocket part is not formed.

The motor box 130 may include a motor box outer wall 133 having a motor accommodating space 131 formed therein, and a coupling bracket 135 protruding from the motor box outer wall 133 to be coupled to the ice making chamber wall 41.

The ice making tray 100 may include the plurality of ice making cells 112, partitions 113 to partition the plurality of ice making cells 112 from each other, and a cell portion 111 having a water channel 114 formed on each of the partitions 113 to allow water to flow between the partitions 113.

The ice making tray 110 may also include a pocket part 118 provided at one side of the cell portion 111 in the longitudinal direction to receive water to be supplied to the ice making cells 112.

The water channel 114 may be formed on the partitions 113 partitioning the plurality of ice making cells 112 to allow water to flow between the partitions 113.

The water channel 114 may include a first surface 115 in contact with ice, a second surface 116 formed at a position facing the first surface 115 and in contact with ice, and a third surface 117 formed between the first surface 115 and the second surface 116 and in contact with ice.

Because the water channel 114 is opened upward and has three surfaces, the third surface 117 may form a bottom surface of the water channel 114.

Among the three surfaces forming the water channel 114, the first surface 115 and the second surface 116 may be configured to have a tapered shape in which a thickness thereof gradually decreases in a direction of directing to ice.

Because the first surface 115 and the second surface 116 is configured to have a tapered shape in which the thickness thereof gradually decreases in a direction of directing to ice, the surfaces in contact with the ice are sharp, so that pieces of ice may be easily separated from the respective ice making cells 112 when the ice making tray 110 is heated by the ice separation heater 170.

When the pieces of ice are easily separated, the pieces of ice are separated and dropped into the ice bucket 80 in a process in which the pieces of ice are transferred to the outside of the ice making tray 110 by the ejector 120, so that noise generated when the pieces of ice are dropped may be reduced.

At this time, because the water channel 114 is formed at a position where pieces of ice exit from the ice making tray 110, that is, a position at which an ejector pin 122 of the ejector 120, which rotates in the direction of an arrow illustrated in FIG. 8, exit from the ice making tray 110, the pieces of ice may be separated by the first surface 115 and the second surface 116 of the water channel 114 even when the pieces of ice are not completely separated.

The ejector pin guide 140 may be attached to a side of the ice making tray 110 to guide the plurality of ejector pins 122.

A plurality of the ejector pin guides 140 is provided to correspond to the number of the ice making cells 112, and each of the ejector pin guide 140 includes a rib-shaped guide lane 141 configured to guide such that pieces of ice may be maintained in a state of being separated from each other in a process in which the pieces of ice to be transferred to the outside of the ice making tray 110 are separated by the ejector 120.

Because by the guide lane 141 pieces of ice may be maintained in a state of being separated from each other in the process in which the pieces of ice are separated, the pieces of ice fall individually so that noise generated when the pieces of ice fall may be reduced.

Figure 9:
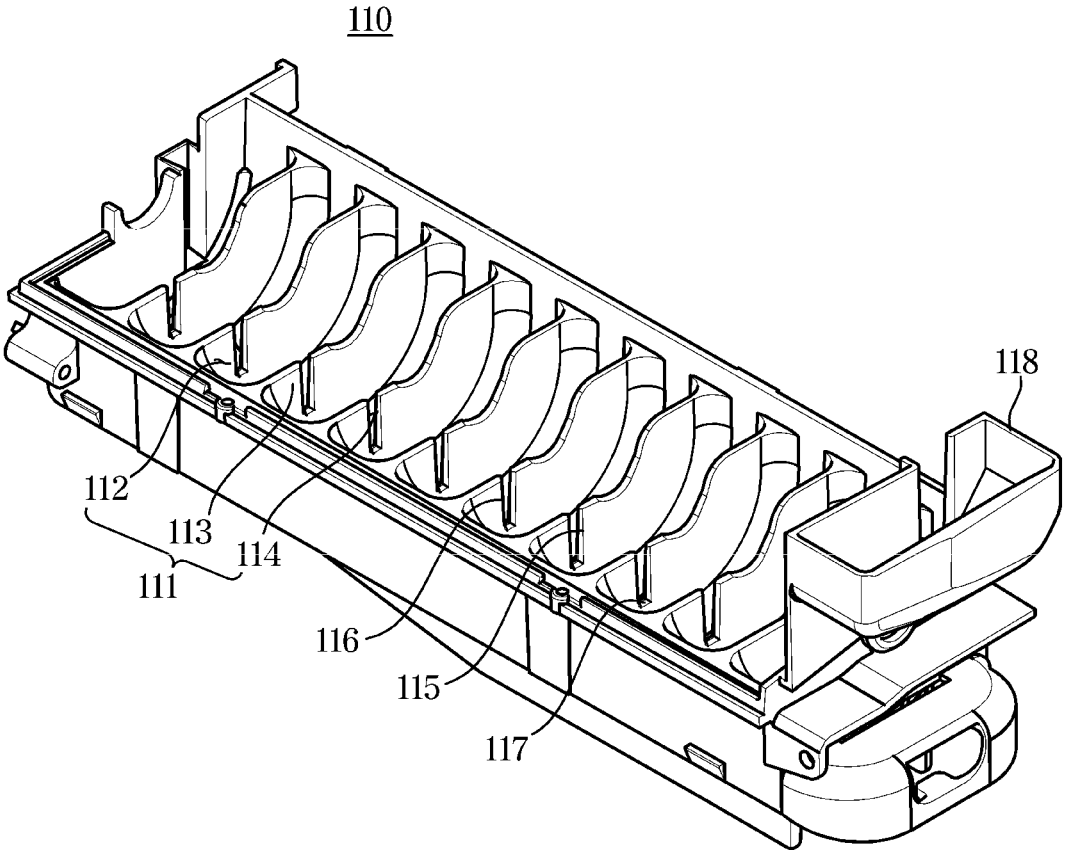
FIG. 9 illustrates an ice making tray in which a water channel is formed according to another embodiment of the present disclosure.
Figure 10:
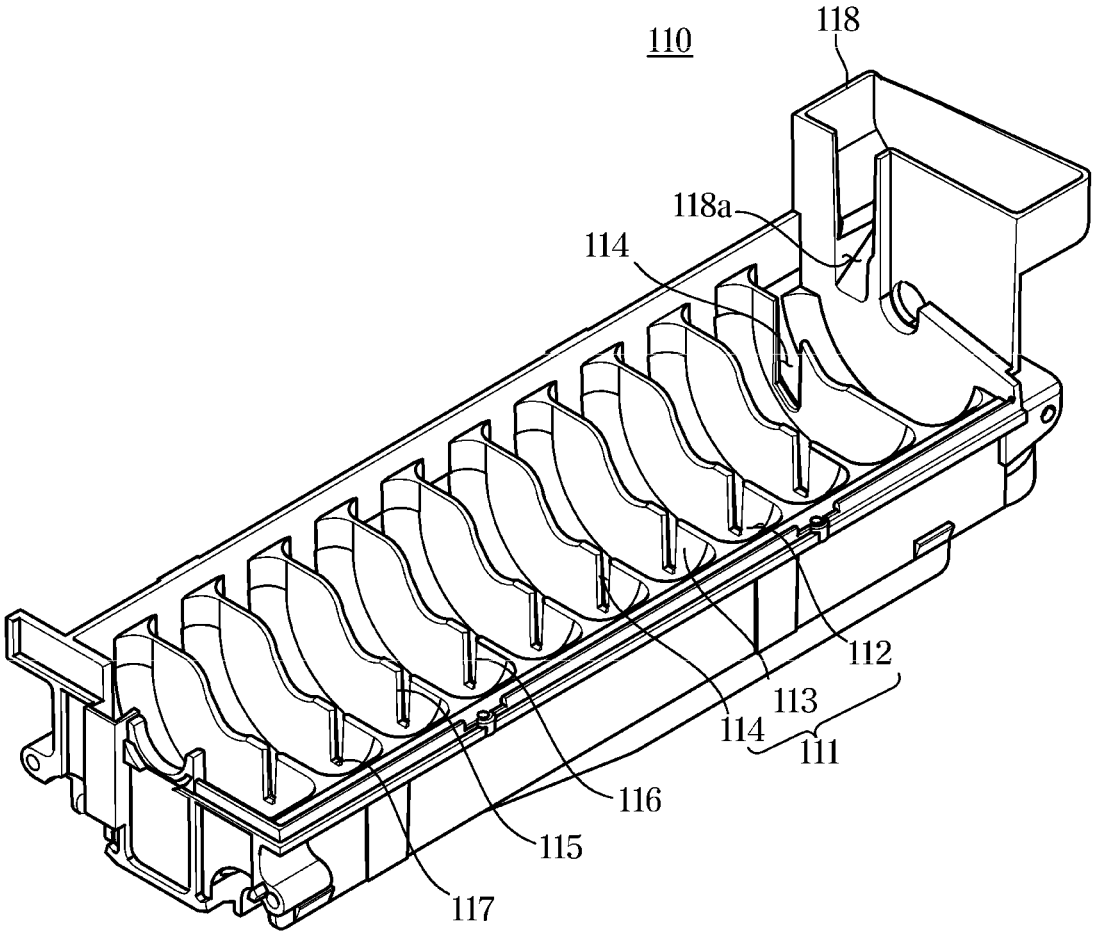
FIG. 10 illustrates the ice making tray viewed from a direction different from that illustrated in FIG. 9.
Figure 11:
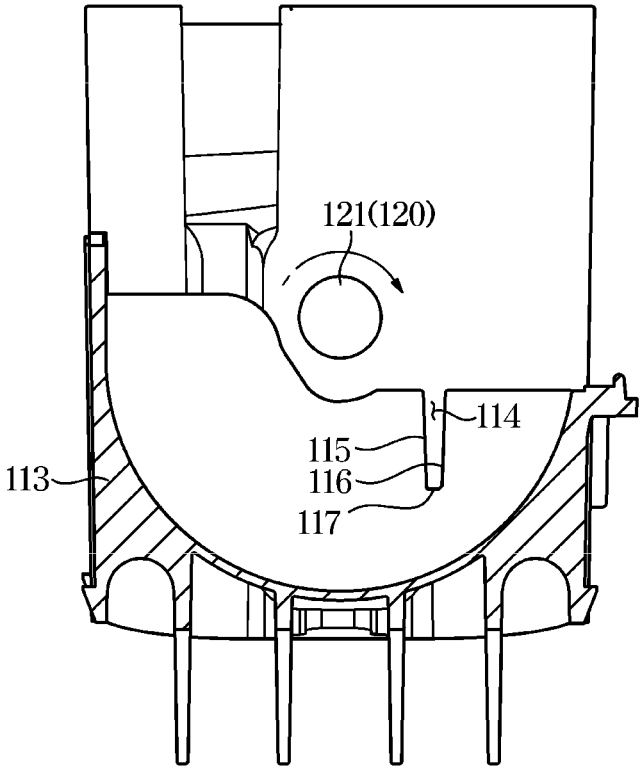
FIG. 11 is a side cross-sectional view of the ice making tray in which the water channel is formed according to another embodiment of the present disclosure.

FIG. 9 illustrates an ice making tray in which a water channel is formed according to another embodiment of the present disclosure, FIG. 10 illustrates the ice making tray viewed from a direction different from that illustrated in FIG. 9, and FIG. 11 is a side cross-sectional view of the ice making tray in which the water channel is formed according to another embodiment of the present disclosure.

As illustrated in FIGS. 9 to 11, in a case where the water channel 114 is formed at a position where the ejector pin 122 of the ejector 120 rotating in the direction of the arrow enters the ice making tray 110, pieces of ice may not be transferred when the pieces of ice are not completely separated by the first surface 115 and the second surface 116 of the water channel 114.

In the case where the water channel 114 is formed at the position where the ejector pin 122 of the ejector 120 enters the ice making tray 110, the other configurations except for the position of the water channel 114 are the same as before, and thus a description thereof will be omitted.

However, in the case where the water channel 114 is formed at the position where the ejector pin 122 of the ejector 120 enters the ice making tray 110, the water channel 114 closest to the pocket part 118 among the water channels 114 may be formed at a position corresponding to a water supply portion 118*a* of the pocket part 118 as illustrated in FIG. 10.

This is because water to be supplied to the ice making tray 110 is supplied to the pocket part 118 and the water supplied to the pocket part 118 is supplied to the ice making cells 112 through the water supply portion 118*a*, and thus the water supplied to the ice making cells 112 may be prevented from flowing back toward the pocket part 118 when the water channel 114 closest to the pocket part 118 among the water channels 114 is formed at the position corresponding to the water supply portion 118*a* of the pocket part 118.

Figure 12:
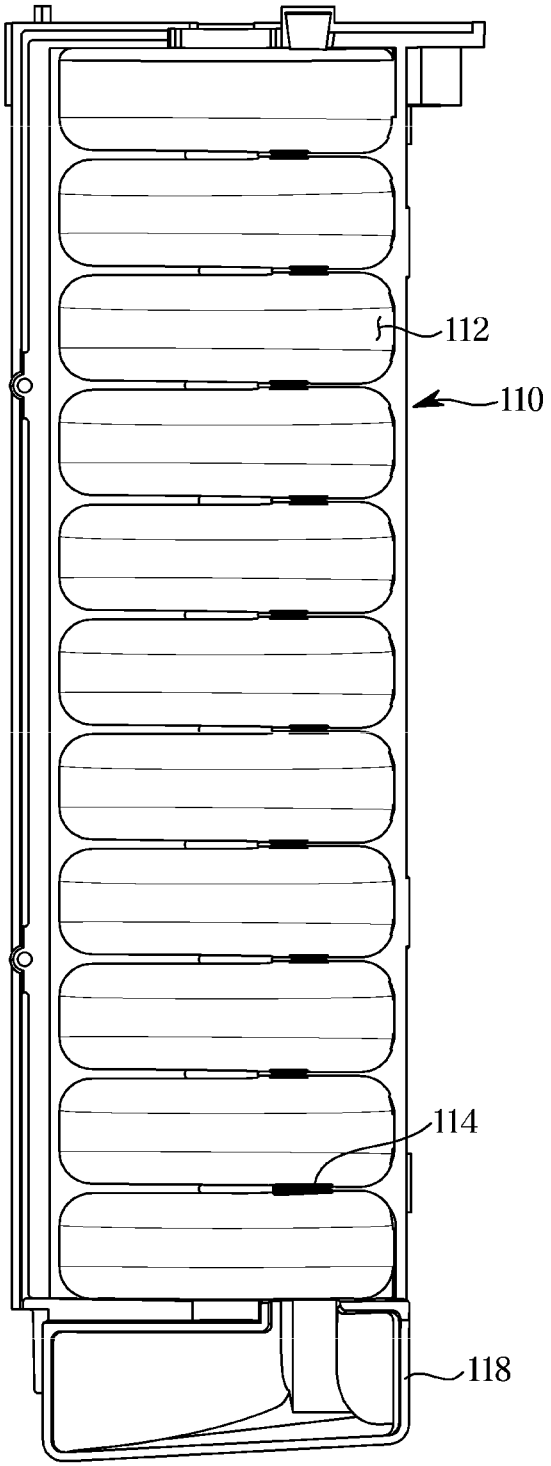
FIG. 12 is a plan view of the ice making tray in which the water channel is formed according to an embodiment of the present disclosure.
Figure 13:
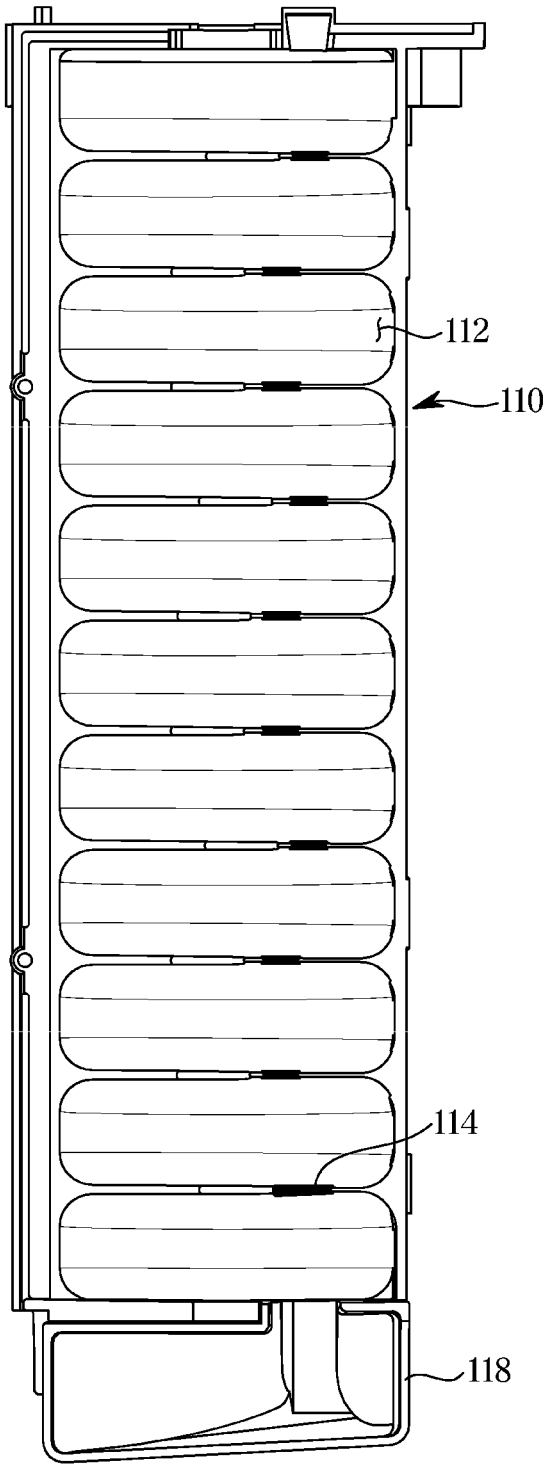
FIG. 13 is a plan view of the ice making tray in which the water channel is formed according to another embodiment of the present disclosure.

FIG. 12 is a plan view of the ice making tray in which the water channel is formed according to an embodiment of the present disclosure, and FIG. 13 is a plan view of the ice making tray in which the water channel is formed according to another embodiment of the present disclosure.

As illustrated in FIG. 12, a plurality of the water channels 114 is provided, and the water channel 114 closest to the pocket part 118 among the water channels 114 may be provided to have a larger width than the remaining water channels 114.

Because water to be supplied to the ice making tray 110 is supplied to the pocket part 118 and the water supplied to the pocket part 118 is supplied to the ice making cells 112 of the ice making tray 110, the water supplied to the ice making cells 112 may be prevented from flowing back toward the pocket part 118 when the water channel 114 adjacent to the pocket part 118 among the plurality of water channels 114 is provided to have a large width.

The remaining water channels 114, except for the water channel 114 adjacent to the pocket part 118, may have the same width, and the water channels 114 facing each other may be positioned to be misaligned with each other.

When the water channels 114 are positioned to be misaligned with each other, because forces acting on pieces of ice by the ejector 120 in the process of separating the pieces of ice are different, the pieces of ice rotated by the ejector 120 have different rotation radii, so that the splitting effect of the pieces of ice may be increased (see FIG. 6).

As illustrated in FIG. 13, some of the remaining water channels 114, except for the water channel 114 adjacent to the pocket part 118, may be formed at positions facing each other, and some of the remaining water channels 114 may be formed at positions misaligned with each other.

As another embodiment, the drawing illustrates that two of the water channels 114 are formed at positions facing each other, the water channels 114 located next to the two water channels 114 are formed at positions misaligned with each other, and this pattern is repeated, but the present disclosure is not limited thereto.

Figure 14:
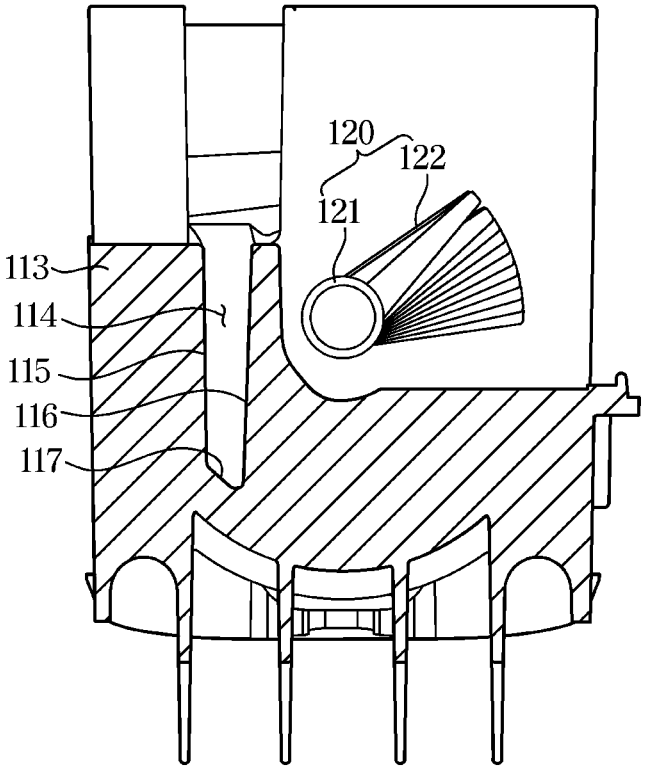
FIG. 14 is a side view of the ice making tray in which an ejector is disposed according to an embodiment of the present disclosure.

FIG. 6 is an exploded perspective view of a part of the ice maker according to an embodiment of the present disclosure, and FIG. 14 is a side view of the ice making tray in which an ejector is disposed according to an embodiment of the present disclosure.

As illustrated in FIGS. 6 and 14, the ejector 120 may include an ejector rotation shaft 121 provided to be rotatable, and the plurality of ejector pins 122 provided to protrude from the ejector rotation shaft 121.

The drawing illustrates that eleven of the ejector pins 122 are provided to correspond to the number of ice making cells 112, but the present disclosure is not limited thereto.

The plurality of ejector pins 122 may be disposed to be spaced apart from each other at a predetermined angle along a circumferential direction of the ejector rotation shaft 121.

The plurality of ejector pins 122 is not provided in parallel with the adjacent ejector pins 122 and is provided to have the predetermined angle with the adjacent ejector pins 122 along the circumferential direction of the ejector rotation shaft 121, so that the respective ejector pins 122 may sequentially come into contact with pieces of ice to separate the pieces of ice from the ice making tray 110.

Because the respective ejector pins 122 sequentially come into contact with pieces of ice to separate the pieces of ice, the pieces of ice are not dropped at the same time and may be separated and dropped sequentially.

Because pieces of ice are separated and dropped sequentially, noise generated when the pieces of ice fall may be reduced.

In this case, it may be appropriate that the ejector pins 122 are disposed such that the ejector pin 122 closest to the pocket part 118 among the plurality of ejector pins 122 first comes into contact with ice.

This is because the ice separation heater 170 provided in a U shape is disposed at a lower portion of the ice making tray 110 so that heat of a higher temperature is transferred toward the pocket part 118, and thus ice in a portion adjacent to the pocket part 118 is first melted and separated.

In this case, it may be appropriate that an angle between the ejector pin 122 closest to the pocket part 118 and the ejector pin 122 farthest from the pocket part 118 is 60 degrees or less.

Figure 15:
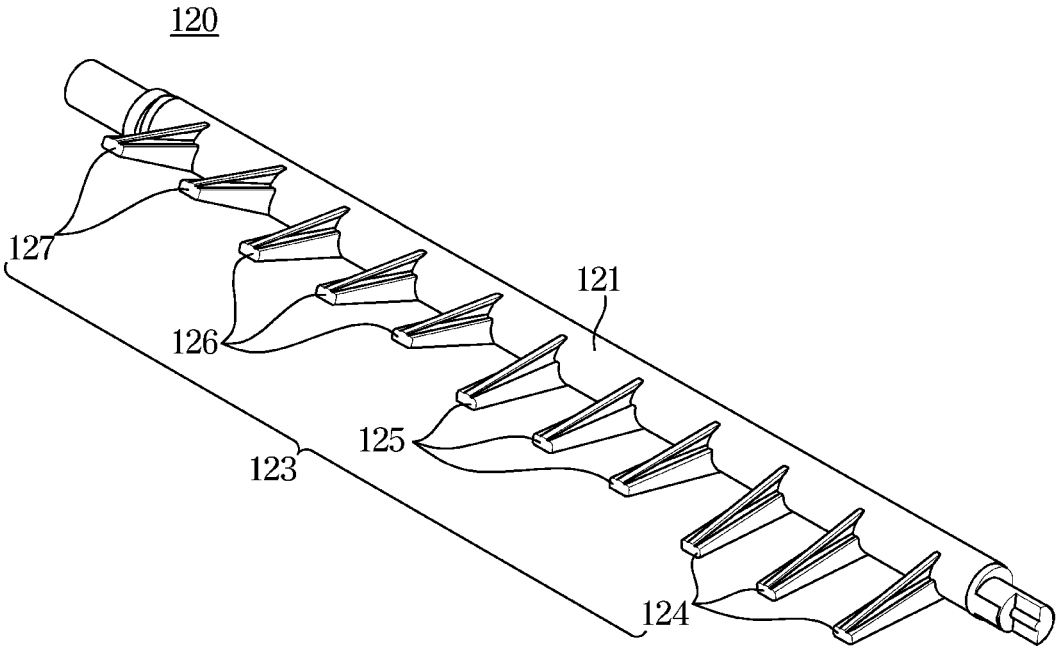
FIG. 15 illustrates an ejector according to another embodiment of the present disclosure.
Figure 16:
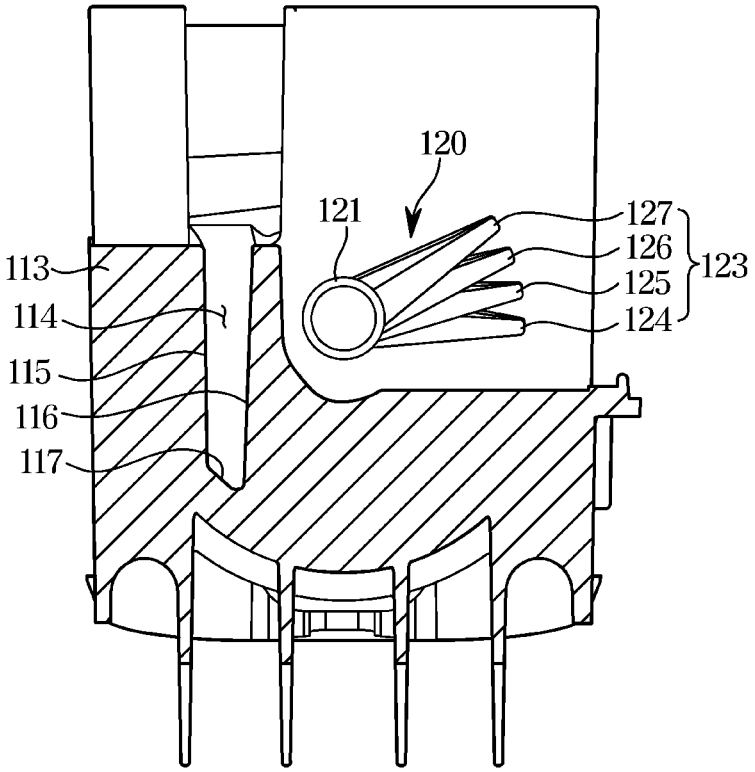
FIG. 16 is a side view of the ice making tray in which the ejector is disposed according to another embodiment of the present disclosure.

FIG. 15 illustrates an ejector according to another embodiment of the present disclosure, and FIG. 16 is a side view of the ice making tray in which the ejector is disposed according to another embodiment of the present disclosure.

As illustrated in FIGS. 15 and 16, the plurality of ejector pins 122 may include a plurality of ejector pin portions 123 disposed to be spaced apart from each other to have the same angle along the circumferential direction of the ejector rotation shaft 121.

The plurality of ejector pin portions 123 may include three of first ejector pin portions 124 provided at a position adjacent to the pocket part 118 and disposed in parallel with the adjacent ejector pins, three of second ejector pin portions 125 having a certain angle with the first ejector pin portions 124 along the circumferential direction of the ejector rotation shaft 121 and disposed in parallel with the adjacent ejector pins, three of third ejector pin portions 126 having a certain angle with the second ejector pin portions 125 along the circumferential direction of the ejector rotation shaft 121 and disposed in parallel with the adjacent ejector pins, and two of fourth ejector pin portions 127 having a certain angle with the third ejector pin portions 126 along the circumferential direction of the ejector rotation shaft 121 and disposed in parallel with the adjacent ejector pins.

As above, when the plurality of ejector pin portions 123 includes three of the first ejector pin portions 124, three of the second ejector pin portions 125, three of the third ejector pin portions 126, and two of the fourth ejector pin portions 127, three pieces of ice coming into contact with three of the first ejector pin portions 124 may first fall.

Then, in sequence, three pieces of ice coming into contact with three of the second ejector pin portions 125 may fall, three pieces of ice coming into contact with three of the third ejector pin portions 126 may fall, and finally two pieces of ice coming into contact with two of the fourth ejector pin portions 127 may fall.

The drawing illustrates that the plurality of ejector pin portions 123 includes three of the first ejector pin portions 124, three of the second ejector pin portions 125, three of the third ejector pin portions 126, and two of the fourth ejector pin portions 127, but the present disclosure is not limited thereto.

For example, two of the first ejector pin portions 124 may be provided, or a fifth ejector pin portion having a different angle may be provided.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a main body having a storage compartment;

a door rotatably coupled to the main body to open and close the storage compartment; and an ice making chamber provided in the door and comprising an ice maker configured to make ice and an ice bucket configured to store the ice produced by the ice maker, wherein the ice maker comprises:

an ice making tray having a plurality of ice making cells for receiving water;

an ice separation heater configured to heat the ice making tray so that ice is separated from the ice making tray;

an ejector rotatably provided to transfer ice separated from the ice making tray to the outside of the ice making tray; and a water channel formed on each of partitions partitioning the plurality of ice making cells to allow water to flow between the partitions and configured such that at least one of surfaces in contact with ice has a tapered shape in which a thickness thereof gradually decreases in a direction of directing to the ice, wherein the ice making tray comprises a pocket part receiving water to be supplied to the plurality of ice making cells, and the water channel closest to the pocket part among a plurality of water channels is configured to have a larger width than the remaining water channels, wherein the remaining water channels are configured to have the same width, and the water channels formed at positions facing each other are formed at positions misaligned with each other.

2. The refrigerator according to claim 1, wherein the water channel comprises a first surface in contact with ice, a second surface formed at a position facing the first surface and in contact with ice, and a third surface formed between the first surface and the second surface and in contact with ice.

3. The refrigerator according to claim 2, wherein the first surface and the second surface are configured to have a tapered shape in which a thickness thereof gradually decreases in the direction of directing to the ice.

4. The refrigerator according to claim 1, wherein the ejector comprises an ejector rotation shaft provided to be rotatable, and a plurality of ejector pins protruding from the ejector rotation shaft.

5. The refrigerator according to claim 4, wherein the plurality of ejector pins is disposed to be spaced apart from each other to have a certain angle along a circumferential direction of the ejector rotation shaft.

6. The refrigerator according to claim 5, wherein the ice separation heater has a U shape and is disposed at a lower portion of the ice making tray so that heat of a higher temperature is transferred toward the pocket part.

7. The refrigerator according to claim 6, wherein the plurality of ejector pins is configured such that the ejector pin closest to the pocket part first comes into contact with ice.

8. The refrigerator according to claim 4, wherein the plurality of ejector pins comprises a plurality of ejector pin portions disposed to be spaced apart from each other to have the same angle along a circumferential direction of the ejector rotation shaft, and the plurality of ejector pin portions is configured to have different angles along the circumferential direction of the ejector rotation shaft.

9. The refrigerator according to claim 8, wherein the ice separation heater has a U shape and is disposed at a lower portion of the ice making tray so that heat of a higher temperature is transferred toward the pocket part.

10. The refrigerator according to claim 9, wherein the plurality of ejector pin portions is configured such that the ejector pin portion closest to the pocket part first comes into contact with ice.

11. The refrigerator according to claim 4, wherein the ice maker further comprises an ejector pin guide configured to guide the plurality of ejector pins.

12. The refrigerator according to claim 11, wherein the ejector pin guide comprises a rib-shaped guide lane configured to guide such that pieces of ice are maintained in a state of being separated from each other in a process in which the pieces of ice to be transferred to the outside of the ice making tray are separated.

* * * * *